United States Patent [19]

Höveler

[11] 4,259,132

[45] Mar. 31, 1981

[54] DEVICE FOR PRESSING LABELS OR FOILS ONTO OBJECTS

[75] Inventor: Egon Höveler, Haan, Fed. Rep. of Germany

[73] Assignee: Jagenberg-Werke Aktiengesellschaft, Dusseldorf, Fed. Rep. of Germany

[21] Appl. No.: 65,829

[22] Filed: Aug. 13, 1979

Related U.S. Application Data

[62] Division of Ser. No. 850,107, Nov. 9, 1977, Pat. No. 4,200,483.

[30] Foreign Application Priority Data

Nov. 13, 1976 [DE] Fed. Rep. of Germany ..... 2651911

[51] Int. Cl.[3] ..... B65C 3/18; B65C 9/36

[52] U.S. Cl. ..... 156/215; 156/212; 156/443; 156/444; 156/475; 156/486; 156/487; 156/566; 156/567; 156/570; 156/DIG. 14; 156/DIG. 38; 156/DIG. 42

[58] Field of Search ..... 156/212, 215, 216, 443, 156/444, 475, 486, 487, 566, 567, 570, 571, DIG. 14, DIG. 16, DIG. 42, DIG. 38

[56] References Cited

U.S. PATENT DOCUMENTS

| | | | |
|---|---|---|---|
| 2,118,527 | 5/1938 | Schmutzer et al. | 156/487 X |
| 4,152,192 | 5/1979 | Zodrow et al. | 156/560 |

*Primary Examiner*—William A. Powell
*Assistant Examiner*—Robert A. Dawson
*Attorney, Agent, or Firm*—Sprung, Felfe, Horn, Lynch & Kramer

[57] ABSTRACT

A device for the pressing of gummed labels or foils against objects which are moved along a straight or curved path, comprises one or more pressing elements disposed one behind the other and movably advanced in synchronism with the objects along a path that is convexly curved with respect to the first path. Each pressing element has a pliable pressure pad disposed at the level of the area which is to be provided with the foil and situated at varying distances from the pressing element. The pressure pad comprises a plurality of elements disposed side by side, which independently of one another exert a point or line pressure during the pressing action.

3 Claims, 2 Drawing Figures

DEVICE FOR PRESSING LABELS OR FOILS ONTO OBJECTS

This is a division of application Ser. No. 850,107, filed Nov. 9, 1977, now U.S. Pat. No. 4,200,483.

BACKGROUND OF THE INVENTION

The invention relates to a device for pressing gummed labels or foils onto objects which are moved forward on a straight or curved path, the device having one or more pressing elements disposed side by side and moving forward in synchronism with the objects on a path that is curved convexly with respect to the first path, the said elements each having a pliable pressure pad at the level of the area of the object which is to be provided with the label or foil and which has a varying distance from the particular pressing element.

Such devices are used in labeling machines. The pressing elements are disposed on a gripper cylinder and have, as the pliable pressure pad, a cushion of foam or foam rubber. The pressing elements serve the purpose of pressing, on as large an area as possible, the label held by the grippers of the gripper cylinder, or the foil held thereby, against the label area of the object, e.g., the bottleneck area, which is at a distance which varies over the height of the label or foil from the mean circulation path of the pickup elements. In order that the pressing may be exercised with great uniformity over the height of the label, the pressure pads are adapted to the shape of the area to be labeled. If the bottleneck is to be labeled, the outside of the pressure pad will have a different distance, as measured over its path of curvature of the curved path of movement of the pickup elements. This means that the path speed of the pressure pad is greater in the area more remote from the center of curvature than in the area closer thereto. On account of these different path speeds within the pressure pad, the label is pulled laterally when the pressure is exercised and does not come into the desired position on the area to be labeled. The lateral dislocation is especially disadvantageous when the labels are printed or marked labels or polygonal foils, because it is easy to see the misalignment of such labels on the object.

SUMMARY OF THE INVENTION

The invention is addressed to the problem of creating a device for pressing labels or foils onto objects of the initially described kind, whereby the labels or foils having a broad gummed surface can be applied without lateral dislocation.

This problem is solved in accordance with an invention by a means of the initially described kind, which is characterized in that the pressure pad consists of a plurality of elements arranged side by side, which independently of one another exercise a point or line pressure during the pressing action.

With the device of the invention, when the pressure is exercised on the label or foil, no torque acting tangentially of the label area is produced which would result in a dislocation of the foil. The difference in the circumferential speeds of the individual elements are equalized by the yielding of these individual elements. No interaction of the elements takes place, in contrast to the action of a pressure pad in which the deformation energy is released in an uncontrolled manner, affecting adjacent areas (The individual areas of the pad yield in the direction of least resistance). Due to the resilience of the individual elements and of the point or linear contact, the pressure pad conforms well to the shape of the label area, so that the label or foil is affixed over a broad surface to the object being labeled.

The elements can be jets of air or liquid. Preferably, however, they are resilient bristles of a brush. This embodiment of the invention is simple in construction and easy to maintain. To permit a very uniform pressure to be exercised on the label or foil over the entire area of the pressure pad, the bristles have the same length and the holder of the bristles is adapted to the shape of the area to be labeled. It is furthermore advantageous for the bristles to be disposed perpendicularly to the area to be labeled.

In the case of an object to which a foil is adhered in the known manner described above, but its marginal areas are not yet adhered, it is known to adhere these as yet unadhered marginal areas by moving the bottle along lateral brushes. In this system, however, in contrast to the method of the invention, only the marginal areas are brushed. The problem that the foil might become dislocated does not occur here, because in the first place the label is already attached and is not acted upon by different torques over the height of the label due to different path speeds.

BRIEF DESCRIPTION OF THE DRAWINGS

The invention will be further explained hereinbelow with the aid of a drawing representing an embodiment thereof. In particular.

DETAILED DESCRIPTION OF THE INVENTION

Figure 2:
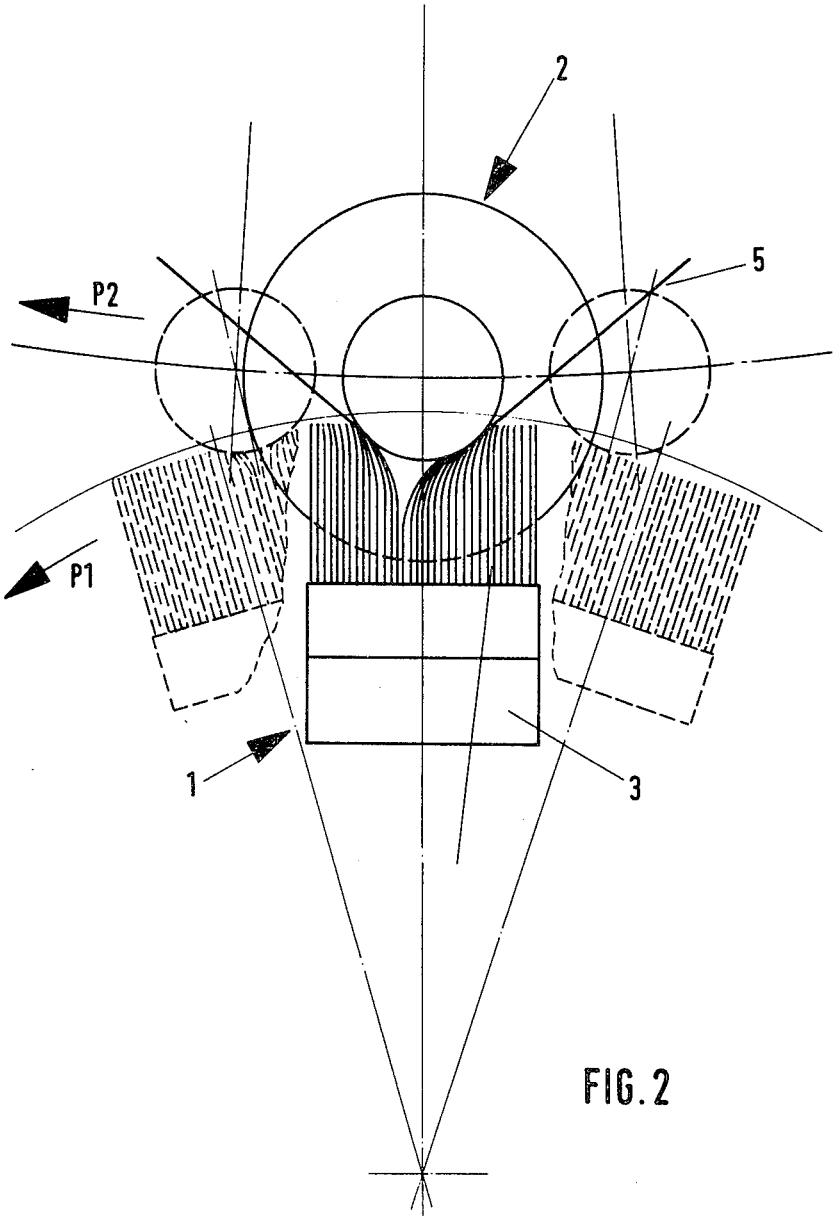
FIG. 2 is a cross-sectional view taken through the object of FIG. 1 along the line A—A.

As shown in FIG. 2, a pressing element 1 carried by a gripper cylinder, which is not shown, moves on a circular path in the direction of an arrow $P_1$, while the object to be labeled, a bottle 2 in this case, is moving on a turntable which is not shown, on a circular path in the direction of the arrow $P_2$. The pressing element and the bottle 2 are moving in synchronism during the pressing action.

Figure 1:
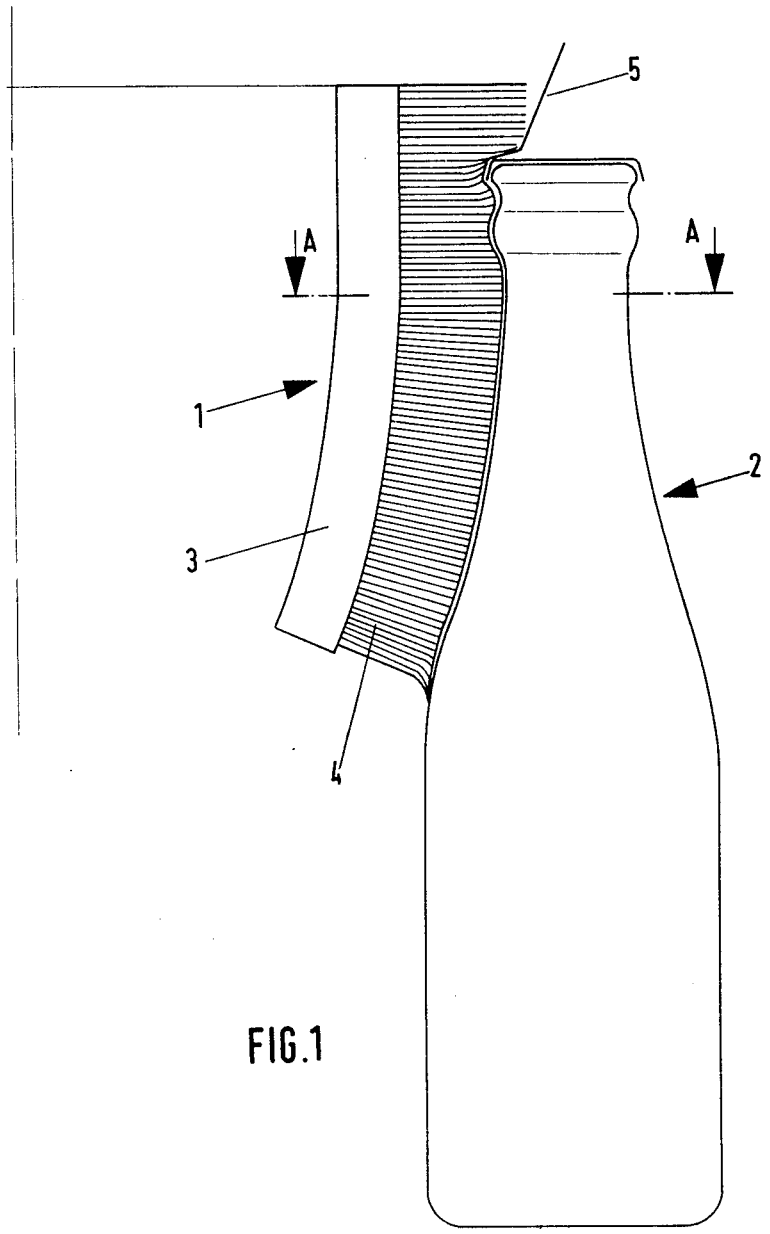
FIG. 1 is a lateral elevational view of a pressing element pressing a foil onto the neck of a bottle.

FIG. 1 shows the pressing element 1 consisting of a support 3 and a pressure pad 4 composed of a plurality of resilient bristles disposed in the manner of a brush. The pressing element 1 is disposed at the level of the bottle neck. The support 3 of the bristles 4 is adapted to the shape of the bottleneck. The bristles 4 all have the same length. On account of the adapted shape and the equal bristle length, the bristles exercise approximately the same pressure over the entire height of the bottleneck.

The operation of the device of the invention is as follows:

A foil gummed on its back is brought by gripper elements, which are not shown, of the gripper cylinder into the area of the bottleneck. It is supported on the front side on the tips of the bristles 4. As soon as the foil 5 is gripped between the bottleneck and the bristles 4, the grippers release the foil, so that then it is only under the action of the bristles 4. As movement continues from the right-hand position shown in broken lines in FIG. 2 into the middle position, the bristles part and at the same time press the foil against the bottleneck. By more or less great bending in the upper and lower areas according to the different circumferential velocities of the bristles, the foil 5 is pressed onto the bottleneck over a relatively broad area. A resultant torque acting tangentially of the bottle, which would result in a dislocation of the foil, does not develop on account of the individual, yielding bristles acting independently of one another. Unlike a continuous pressure pad, the individual bristles come away as movement continues from the right side represented in FIG. 2. They cannot pull the label with them, because the other bristles remaining on this side act as barbs and hold the foil fast. The forces acting on the foil remain symmetrical even during the parting movement, as shown by the broken lines on the left in FIG. 2. At no time, therefore, is a torque able to form which would result in dislocation. Of course, the adhesive force between the bottle and the foil, which is substantially greater than the friction between the brush and the foil, plays a part here, too.

Instead of the individual bristles, other corresponding elements can also serve, such as pins. It is also possible to substitute air or liquid jets for the bristles.

It is to be understood that the device can be used wherever different relative speeds occur, in the application of labels or the like, between the object to be labeled and the pressing element.

It will be appreciated that the instant specification is set forth by way of illustration and not limitation, and that various modifications and changes may be made without departing from the spirit and scope of the present invention.

What is claimed is:

1. In a method for labeling objects having a noncylindrical portion and moveable in the straight or curved path, the improvement comprising: releasably positioning gummed labels or foils at the level of the noncylindrical portion; and applying the labels or foils, when released by the gripper elements, to the objects by providing at least one pressing element having a pliable pad disposed at the level of the noncylindrical portion which is to be provided with the label or foil with a plurality of elements disposed side by side, which independently of one another exert one of a point or line pressure during the applying action and advancing the at least one pressing element in synchronism with the objects along a path that is convexly curved with respect to the object path.

2. The method according to claim 1, wherein the pad elements are resilient brush bristles and the bristles are provided with an equal length and are held to be substantially configured to the shape of the area to be labeled.

3. The method according to claim 1, wherein the pad elements are resilient brush bristles and the bristles are directed perpendicularly to the area to be labeled.

* * * * *